United States Patent [19]

Word

[11] 3,952,353

[45] Apr. 27, 1976

[54] SKI WALKERS

[76] Inventor: John H. Word, Rte. No. 2, Box 341, Frankfort, Ky. 40601

[22] Filed: July 22, 1974

[21] Appl. No.: 490,880

[52] U.S. Cl. ..... 9/310 D; 115/25

[51] Int. Cl.[2] ..... A63C 15/02; A63C 15/04

[58] Field of Search ..... 9/310 D, 310 R, 310 A, 9/310 F; 115/25; 272/1 B

[56] References Cited

UNITED STATES PATENTS

| | | | |
|---|---|---|---|
| 3,031,695 | 5/1962 | Kunkel | 9/310 A |

FOREIGN PATENTS OR APPLICATIONS

| | | | |
|---|---|---|---|
| 720,242 | 12/1931 | France | 9/310 D |
| 163,091 | 10/1948 | Austria | 9/310 D |
| 65,496 | 10/1955 | France | 9/310 D |
| 1,373,564 | 8/1964 | France | 9/310 D |

*Primary Examiner*—Trygve M. Blix
*Assistant Examiner*—Charles E. Frankfort

[57] ABSTRACT

A one piece, flexible, inflatable device for converting a water ski to a buoyant water walking apparatus. The device comprising: a pair of integrally formed inflatable tubes; one of the tubes extending around and engaging the entire periphery of the water ski, the other of the tubes extending along and forming a support for a bottom portion of the water ski; the tubes, when inflated, forming an elongated pocket for receiving and gripping the water ski.

1 Claim, 1 Drawing Figure

SKI WALKERS

The present invention relates to a pair of flexible inflatable devices to be attached to a pair of water ski inexpensively and quickly to permit the wearer to walk on the water.

Another important object of the ski walkers would be to permit the wearer to surf in the wake of a boat. That is to be propelled in the same direction the boat is moving by the motion of a wave produced by the boat.

The ski walkers consist of a plurality of flexible tubes connected longitudinally with openings between the tubes for air to pass from one tube to an adjacent tube.

The ski walkers are designed so as not to interfere with the foot piece on the water ski, said foot piece being used to secure the water ski to the wearer.

The ski walkers shall have attached to them a plurality of flexible propulsion cups attached to and depending from the bottom of the ski walkers. Said cups being transversely attached to the bottom in longitudinally spaced positions.

Other and subordinate objects are also comprehended by my invention all of which together with the precise nature of the ski walkers will be readily understood when the succeeding description and claim are read with reference to the drawings accompanying and forming part of this specification.

Figure 1:
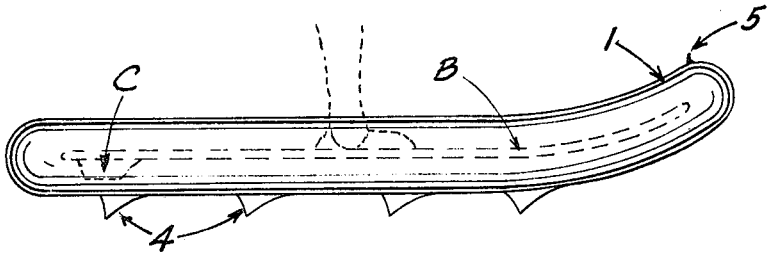
FIG. 1 is a side elevational view showing the ski walker attached to a water ski. The water ski not being part of this invention, but the ski walker is designed to be used with the water ski.
Figure 2:
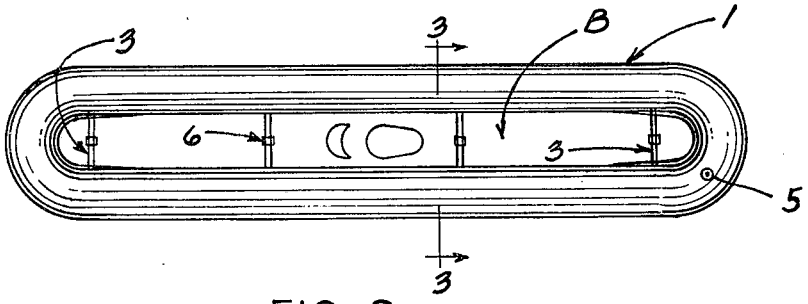
FIG. 2 is a top plan view of a water ski with the ski walker attached. Only one of the ski walkers is shown but they are to be used in pairs one on either foot.
Figure 3:
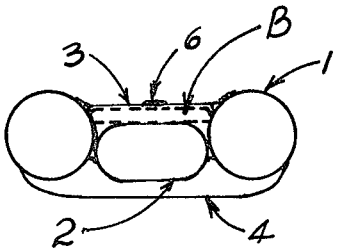
FIG. 3 is a cross section through one of the ski walkers on the line 3—3 of FIG. 2 looking in the direction of the arrows.

With reference now to the drawings 1 is the outside tube which goes completely around the outside of the ski. The inside tube 2 is attached longitudinally to the outside tube and have openings to allow air to pass from one tube to another. The inside tube becomes smaller in diameter at each end and is rounded to be streamlined and to follow the shape of the ski B. The center tube 2 is flexible enough to allow the tube to fit around the rudder of the ski c and still give rudder action. The strap 3 is attached to the outside tube 1 and has attached to it a buckle 6 for adjustment to keep the ski walkers securely attached to the ski. B The valve 5 is used to put air in all of the tubes 1 and 2. The propulsion cups 4 are securely attached across the bottom of the tubes 1 and 2 and are shaped so as to catch water and resist a backward movement of the ski walkers. As the foot is moved forward in the water these flexible cups 4 fold against the bottom and provide very little resistance to forward movement. It should be understood that various changes and modifications may be made, within the scope of the appended claim, without departing from the spirit of the invention.

What is claimed is:

1. A one piece, flexible, inflatable device for converting a water ski to a buoyant water walking apparatus, comprising:

a pair of integrally formed inflatable tubes, one of said tubes extending around and engaging the entire periphery of said water ski and the other of said tubes extending along and forming a support for a bottom portion of said water ski, said tubes being provided with openings to allow air to pass from one tube to the other;

the tubes, when inflated, forming an elongated pocket for receiving and gripping said water ski;

the one of said tube being provided with transversely extending strap means to assist in attaching the inflatable device to said water ski, and the other of said tubes being provided with propulsion cups on a bottom portion thereof to assist in moving said buoyant apparatus over the surface of the water.

* * * * *